US011484992B2

(12) United States Patent
Collard et al.

(10) Patent No.: US 11,484,992 B2
(45) Date of Patent: Nov. 1, 2022

(54) TOOL FOR RETRIEVING MAGNETIC OBJECTS

(71) Applicants: Ryan Collard, Granby, CT (US); Andriy Andriyevskyy, Stamford, CT (US); Alberto Torres, Stamford, CT (US)

(72) Inventors: Ryan Collard, Granby, CT (US); Andriy Andriyevskyy, Stamford, CT (US); Alberto Torres, Stamford, CT (US)

( * ) Notice: Subject to any disclaimer, the term of this patent is extended or adjusted under 35 U.S.C. 154(b) by 218 days.

(21) Appl. No.: 16/947,968

(22) Filed: Aug. 26, 2020

(65) Prior Publication Data

US 2022/0063062 A1 Mar. 3, 2022

(51) Int. Cl.

| | |
|---|---|
| ***B25B 27/00*** | (2006.01) |
| ***B25B 11/00*** | (2006.01) |
| ***B25B 27/30*** | (2006.01) |
| ***B25G 1/02*** | (2006.01) |

(52) U.S. Cl.

CPC ..... *B25B 11/002* (2013.01); *B25B 27/30* (2013.01); *B25G 1/02* (2013.01)

(58) Field of Classification Search

CPC .. B25B 3/00; B25B 5/00; B25B 11/00; B25B 11/005; B25B 27/30; B25G 1/00; B25G 1/02

See application file for complete search history.

(56) References Cited

U.S. PATENT DOCUMENTS

| | | | | |
|---|---|---|---|---|
| 1,521,173 | A * | 12/1924 | Catching | H01F 7/206 600/11 |
| 2,806,396 | A * | 9/1957 | Miller | B25B 23/12 403/DIG. 1 |
| 5,381,319 | A | 1/1995 | Shiao | |
| 5,515,250 | A | 5/1996 | Ortega | |
| 5,704,674 | A | 1/1998 | Boozer | |
| 6,312,138 | B1 | 11/2001 | Chang | |
| 9,248,558 | B1 * | 2/2016 | Burkhardt | H01F 7/206 |
| 9,718,175 | B1 | 8/2017 | Burkhardt | |
| 11,224,966 | B2 * | 1/2022 | Kuter-Arnebeck | B25J 15/0608 |
| 2010/0107827 | A1 | 5/2010 | Miller | |
| 2010/0037442 | A1 | 10/2010 | Branon | |
| 2022/0063062 | A1 * | 3/2022 | Collard | H01F 7/0257 |

OTHER PUBLICATIONS

Goodson Tools and Supplies, Magnetic Head Bolt Washer & Valve Spring Shim Removal Tools, https://goodson.com/products/bolt-shim-removers.

* cited by examiner

*Primary Examiner* — Lee D Wilson

(74) *Attorney, Agent, or Firm* — Emanus, LLC; Willie Jacques

(57) ABSTRACT

A tool for retrieving magnetic objects. The tool comprising a flexible rod; a handle, connected to a first end of the flexible rod; and a magnetic head, connected to a second end of the flexible rod. Further, the magnetic head comprises a through-hole for retrieving the magnetic objects.

18 Claims, 6 Drawing Sheets

TOOL FOR RETRIEVING MAGNETIC OBJECTS

FIELD OF THE DISCLOSURE

The invention relates to a tool kit, and particularly relates to a tool for retrieving magnetic objects.

BACKGROUND OF THE DISCLOSURE

The subject matter discussed in this background section should not be assumed to be prior art merely as a result of its mention herein. Similarly, any problems mentioned in this background section or associated with the subject matter of this background section should not be assumed to have been previously recognized in the prior art. The subject matter as disclosed in this background section merely represents different approaches related to tools for retrieving magnetic objects, wherein such tools themselves may also correspond to implementations of the claimed technology and invention.

Increasing design constraints placed on the development of modern machinery has resulted in removable objects typically used for securing of parts or passageway closures to be disposed of in limited access areas. In many instances removable objects are better suited for removal/installation from more desirable remote locations, however, intricate and tightly-spaced machinery designs forgo better removal/installation options. In addition, the removable objects of this disclosure are typically magnetic and/or sit upon magnetic articles. Furthermore, the magnetic objects may be, but not necessarily be, threaded and have at least a portion thereof exhibiting a substantial shape (e.g., circular, hexagonal, rectangular, etc.). It is an object of the present disclosure to provide for the removal of the magnetic objects like automotive cylinder head stud washers and automotive cylinder head valve spring spacers, nuts, and the like.

Further, an automobile engine "valve job" involves removal of valve cover and cylinder head, followed by disassembly and removal of each valve (i.e., magnetic objects) from the cylinder head for replacement or repair. This process includes the removal of components such as shims, springs, and washers from each cylinder head stud. It has proven to be very challenging for most mechanics to access and remove these washers from each cylinder head stud. In an aspect, the difficulty and challenge with the component removal process is that the components—e.g., a washer is rather small and difficult to locate and manipulate. To make matters worse, the exemplary washers are generally located in very close-fitted recesses which makes the parts somewhat inaccessible and difficult to manipulate.

Prior art, for various aspects contained there within, relevant to this disclosure includes U.S. Pat. No. 9,718,175 to Burkhardt, U.S. Pat. No. 6,312,138 to Coleman, U.S. Pat. Pub. No 2010/037,442 to Branon, U.S. Pat. No. 5,515,250 to Ortega, and Non-Patent literature titled—"Magnetic Head Bolt Washer & Valve Spring Shim Removal Tools". In each of the prior art references, a tool is provided to be used for removal of a magnetic member. However, the prior art fails to address the problem of retrieving magnetic objects from inaccessible areas.

In particular, the Burkhardt reference '175 discloses a universal device and method for manipulating a magnetic object with at least a portion thereof having a substantially prismatic shape with side surfaces and an end surface such as a fastener, bolt, nut, plug, and screw. The head assembly includes a body and a magnetic pole piece. The body serves to support the magnetic pole piece and the magnetic pole piece is configured to contact no more than two side surfaces of the magnetic object. However, unlike the subject matter of the disclosed invention, Burkhardt does not discuss or suggest the use of a magnetic head with a through-hole and coupled to a flexible rod.

Reference '138 to Coleman discloses a lighted magnetic retrieval tool including a magnet member having a pickup surface and an opening in the pickup surface; and a light member for directing light through the opening whereby light can be directed at objects to be retrieved with the pickup surface. However, unlike the subject matter of the disclosed invention, Coleman does not discuss or suggest the use of a flexible rod coupled to a detachable handle and a detachable magnetic head with a through-hole.

Reference '442 to Branon discloses a removal tool for removing washers located on each cylinder head stud when performing a valve job on an automobile engine. The removal tool includes a cylindrical body having a handle portion and a washer removal end opposite the handle. The cylindrical body includes a central bore that extends the axial length of the body. The removal end includes an end surface having at least one embedded magnet member and defines a pickup surface for use in attracting and securing the easy removal of automotive cylinder head stud washers and automotive cylinder head valve spring spacers from the cylinder head. However, unlike the subject matter of the disclosed invention, Branon does not discuss or suggest the use of a flexible rod coupled to a detachable handle and a detachable magnetic head with a through-hole. Furthermore, the '442 reference does not use a single solid magnet member including a through-hole, rather the tool is comprised of a plurality of magnet members disposed along the circumference of the head of the retrieval tool.

Reference '250 to Ortega discloses a device for removing valve spring shims from automotive cylinder heads, the device being constructed in the form of a hand tool having a pair of prongs at the end of a shaft, with a magnet installed in each prong. The prongs are extended to face elements which are flushed with or project slightly from the end of the valve shim tool. However, unlike the subject matter of the disclosed invention, Ortega does not discuss or suggest the use of flexible rod coupled to a detachable handle and a detachable magnetic head with a through-hole.

Reference 'Magnetic Head Bolt Washer & Valve Spring Shim Removal Tools discloses a magnetic head bolt washer and valve spring shim removal tool, comprising a hollow design for easy access over studs. However, unlike the subject matter of the disclosed invention, the prior art does not discuss or suggest the use of flexible rod coupled to a detachable handle and a detachable magnetic head with a through-hole. Furthermore, the 'Magnetic Head Bolt Washer & Valve Spring Shim Removal Tools reference does not use a single solid magnet member including a through-hole, rather the tool is comprised of a plurality of magnet members disposed along the circumference of the head of the retrieval tool.

Given the deficiencies of the prior art, the need remains for an effective hand tool for retrieving magnetic objects from inaccessible areas.

SUMMARY OF THE DISCLOSURE

According to embodiments illustrated herein, there is shown and described a novel, simple, inexpensive, and universal tool for retrieving magnetic objects. The tool comprises a flexible rod, a handle connected to a first end of the flexible rod, and a magnetic head connected to a second end of the flexible rod. The flexible rod may be of any length and diameter and made from various materials including steel, aluminum, polymer, etc. Further, the magnetic head comprises a through-hole for retrieving the magnetic objects while avoiding being obstructed by pins, studs, and the like where such magnetic objects may be disposed. Further, the handle is detachably coupled to the first end of the flexible rod. The magnetic head is detachably coupled to the second end of the flexible rod.

In one example embodiment, the tool is a part of a tool-kit comprising a plurality of magnetic head sizes and flexible rods of variable lengths. The plurality of magnetic head sizes is interchangeably used as per the requirement. Further, a light member is disposed within the handle, to aid visibility for accessing the magnetic objects in dark environments. Further, a light member is disposed within/on the magnetic head, to aid user visibility of autonomous engine sections. Thus, the magnetic head retrieves a washer or shim from inaccessible areas like automotive engine sections.

In another exemplary embodiment, the tool comprises a magnetic head, including a through-hole, having a flexible rod connected at the magnetic head, whereby the connected rod does not obstruct the through-hole of the magnetic head.

Other features and aspects of this disclosure will be apparent from the following description and the accompanying drawings.

BRIEF DESCRIPTION OF THE DRAWINGS

While the specification concludes with claims particularly pointing out and distinctly claiming particular embodiments of the present disclosure, various embodiments of the present disclosure can be more readily understood and appreciated from the following descriptions of various embodiments of the present disclosure when read in conjunction with the accompanying drawings, in which:

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Some embodiments of this disclosure, illustrating all its features, will now be discussed in detail. The words "comprising," "having," "containing," and "including," and other forms thereof, are intended to be equivalent in meaning and be open-ended in that an item or items following any one of these words is not meant to be an exhaustive listing of such item or items, or meant to be limited to only the listed item or items.

It must also be noted that as used herein and in the appended claims, the singular forms "a," "an," and "the" include plural references unless the context dictates otherwise. Although any number of systems and methods similar or equivalent to those described herein can be used in the practice or testing of embodiments of the present disclosure, the preferred systems, and methods are now described.

Embodiments of the present disclosure will be described more fully hereinafter with reference to the accompanying drawings in which like numerals represent like elements throughout the several figures, and in which example embodiments are shown. Embodiments of the present disclosure may, however, be embodied in alternative forms and should not be construed as being limited to the embodiments set forth herein. The examples set forth herein are non-limiting examples and are merely examples among other possible examples.

Figure 1A:
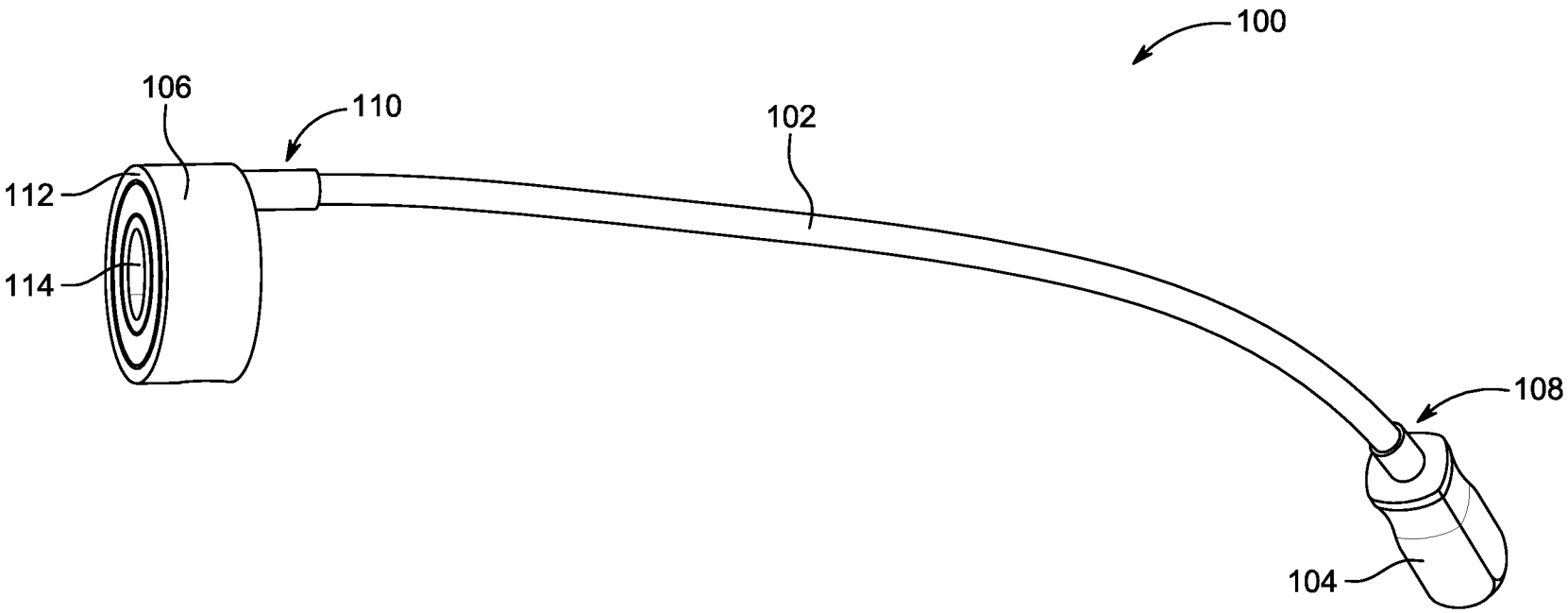
FIG. 1A illustrates a perspective view of a tool for retrieving magnetic objects, according to an embodiment of the present disclosure.

FIG. 1A illustrates a perspective view of a tool 100 for retrieving magnetic objects in accordance with an embodiment of the present disclosure. The tool 100 comprises a flexible rod 102, a handle 104, and a magnetic head 106. FIG. 1A is explained in conjunction with FIG. 1B, FIG. 2, and FIG. 3.

Figure 1B:
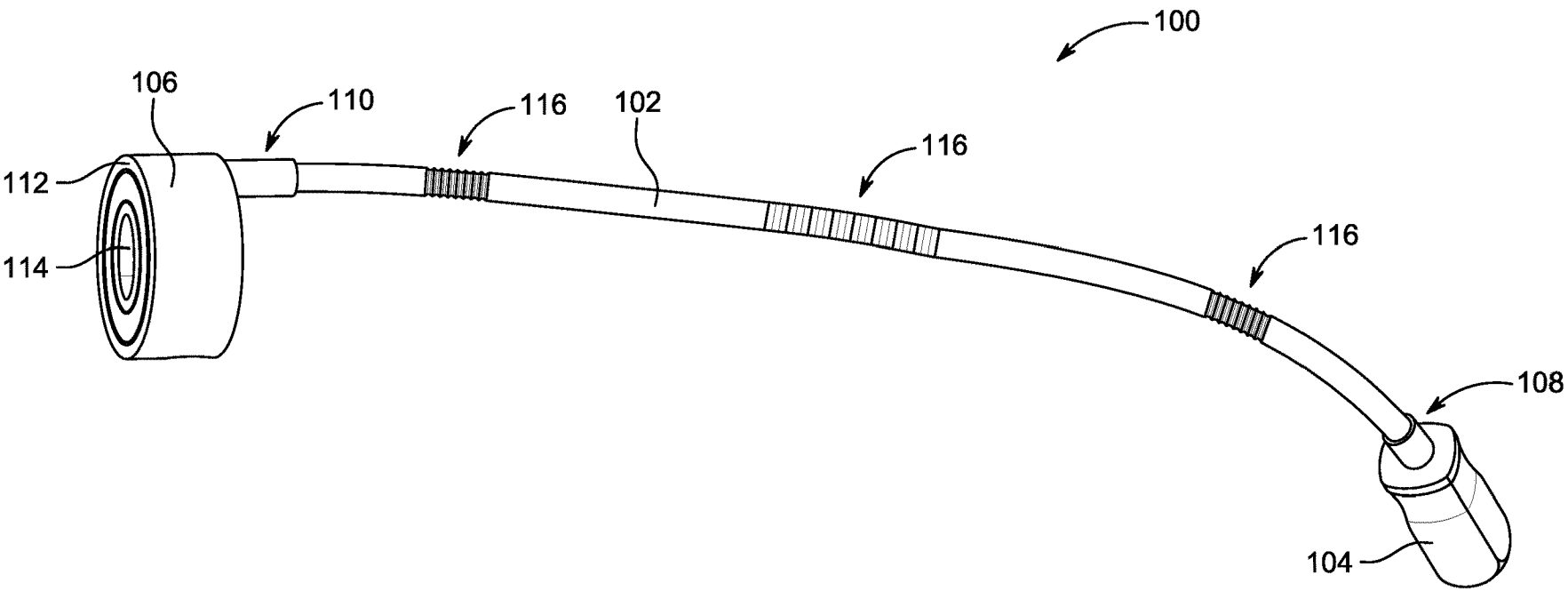
FIG. 1B illustrates a perspective view of a tool showing a flexible rod is extendable for retrieving magnetic objects, according to another embodiment of the present disclosure.

As shown in FIGS. 1A and 1B, the flexible rod 102 may be semi-rigid in nature and be fashioned to assume various semi-rigid shapes or configurations—e.g., straight, curved, multi-curved, angular, etc. In an example embodiment, the flexible rod 102 may be preferably manufactured from steel. The flexible rod 102 may be used to allow the magnetic head 106 to be oriented in different directions for retrieval of the magnetic objects. The flexible rod 102 may be of any length and diameter and made from various materials including steel, aluminum, polymer, etc. Further, the handle 104 may be configured to be detachably coupled to a first end 108 of the flexible rod 102. The handle 104 may preferably be manufactured from a lightweight durable rigid material, such as plastic. Further, the handle 104 may be desirably provided with a finger grip contours (not shown) for better gripping of the tool/handle. It should be noted that the handle 104 may be coaxially attached to the first end 108 of the flexible rod 102, as shown in FIG. 2.

Further, the magnetic head 106 may be configured to be detachably coupled to a second end 110 of the flexible rod 102. The flexible rod 102 may be configured to allow the magnetic head 106 to be oriented in different directions for retrieval of the magnetic objects.

As shown in FIGS. 1A and 1B, the magnetic head 106 is preferably a cylindrical member defining a surface (i.e. a pickup surface) 112. In one example embodiment, the surface 112 may be a cavity (not shown), for accepting and securing a magnetic object. The magnetic head 106 may be a permanent magnet or may be comprised of a ferromagnetic material, such as steel, configured to be magnetically engaged as the magnetic head 106. In an embodiment, the magnetic head 106 is constructed from a Neodymium Super Strong N50 rare earth magnet. It should be noted that the magnetic head 106 may have a through-hole 114. Further, the through-hole 114 of the magnetic head 106 may be demagnetized, to prevent the tool 100 from adhering or attaching to the studs, pins, and the like. It should be noted that the magnetic head 106 may be made of any other magnetic material as well, without departing from the scope of the disclosure. In an example embodiment, the magnetic head 106 is preferably a substantially cylindrical member defining the surface 112 for use in attracting or securing the magnetic object. The magnetic head 106 may further comprise a cavity (not shown) to secure the magnetic objects such as washer or shim. It should be noted that the magnetic head 106 may be advantageously provided with the cavity for easy and secure retrieval of the magnetic object from an inaccessible area like studs in automobile engines.

Figure 2:
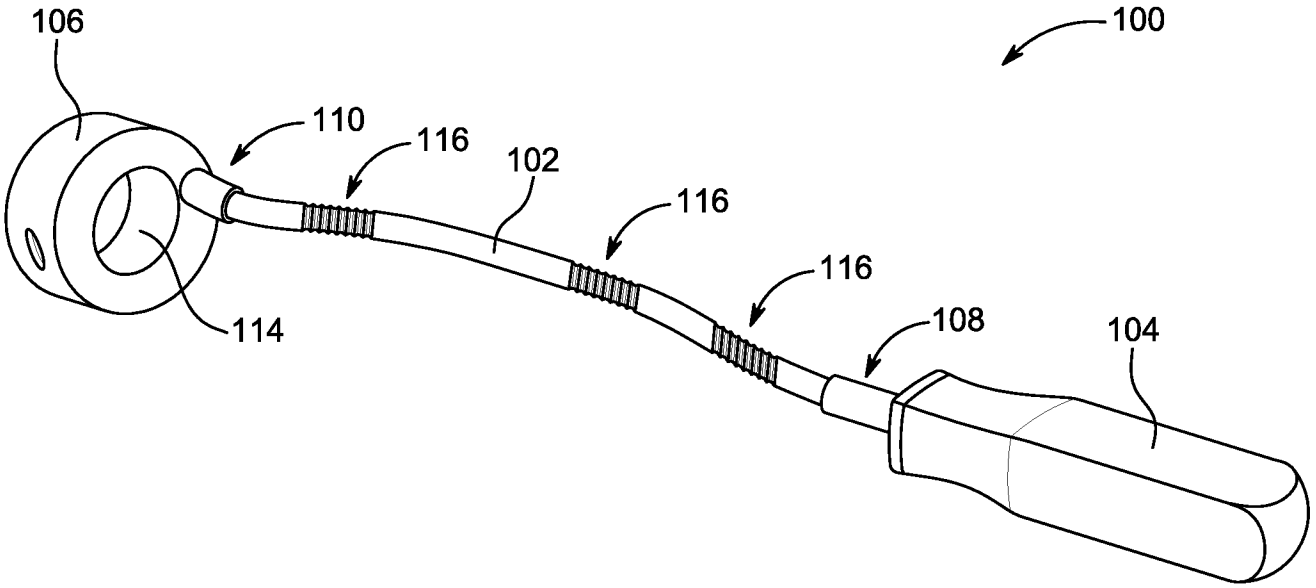
FIG. 2 illustrates another perspective view of the tool for retrieving magnetic objects, according to an embodiment of the present disclosure.

Further, the magnetic head 106, may comprise the through-hole 114, as shown in FIGS. 1A, 1B, and 2. It should be noted that the through-hole 114 may be advantageously provided so that the tool 100 may access the magnetic object like fasteners or washers from the pins, studs, and the like in the automobile engines. In one example embodiment, the magnetic head 106 may be available in different sizes, based at least on the use case and specifications of the magnetic object such as shape or material. In accordance with the present invention, the magnetic head 106 may be any suitable magnet having sufficient strength for retrieving the magnetic object. In one example embodiment, the magnetic object may be, but is not limited to, screws, nails, thumbtacks, or socket attachments from socket wrench kits. Further, different strength magnets may be used for different applications. In one example embodiment, the magnetic head 106 may be anodized. Anodizing of the magnetic head 106 is useful for cosmetic purposes and/or for identifying magnetic heads of different strengths, shapes, surface diameters, and other features. In another example embodiment, the magnetic head 106 may comprise a planar surface for attracting ferrous materials.

Further, the use of magnetic head 106 may allow the magnetic object, to stay magnetically attracted to the tool 100, after retrieval and prevent the loss of the magnetic object. It should be noted that the magnetic head 106 may be coupled with one or more external magnets (not shown) for increasing the magnetic strength of the tool 100, without departing from the scope of the disclosure.

In one example embodiment, the flexible rod 102 may be extendable/retractable, using a plurality of extendable/retractable sections 116, as shown in FIG. 1B. The plurality of extendable/retractable sections 116 may be provided at various points along the length of the flexible rod 102. It should be noted that the plurality of extendable/retractable sections 116, may be advantageously provided for allowing a user to set different lengths of the flexible rod 102, as per the requirement of the user. As shown in FIG. 1B, the plurality of extendable/retractable sections 116 of the flexible rod 102 may be shown in an expanded state. In another example embodiment, as shown in FIG. 2, an extendable/retractable section 116 of the flexible rod 102 may be shown in a retracted state.

Figure 3:
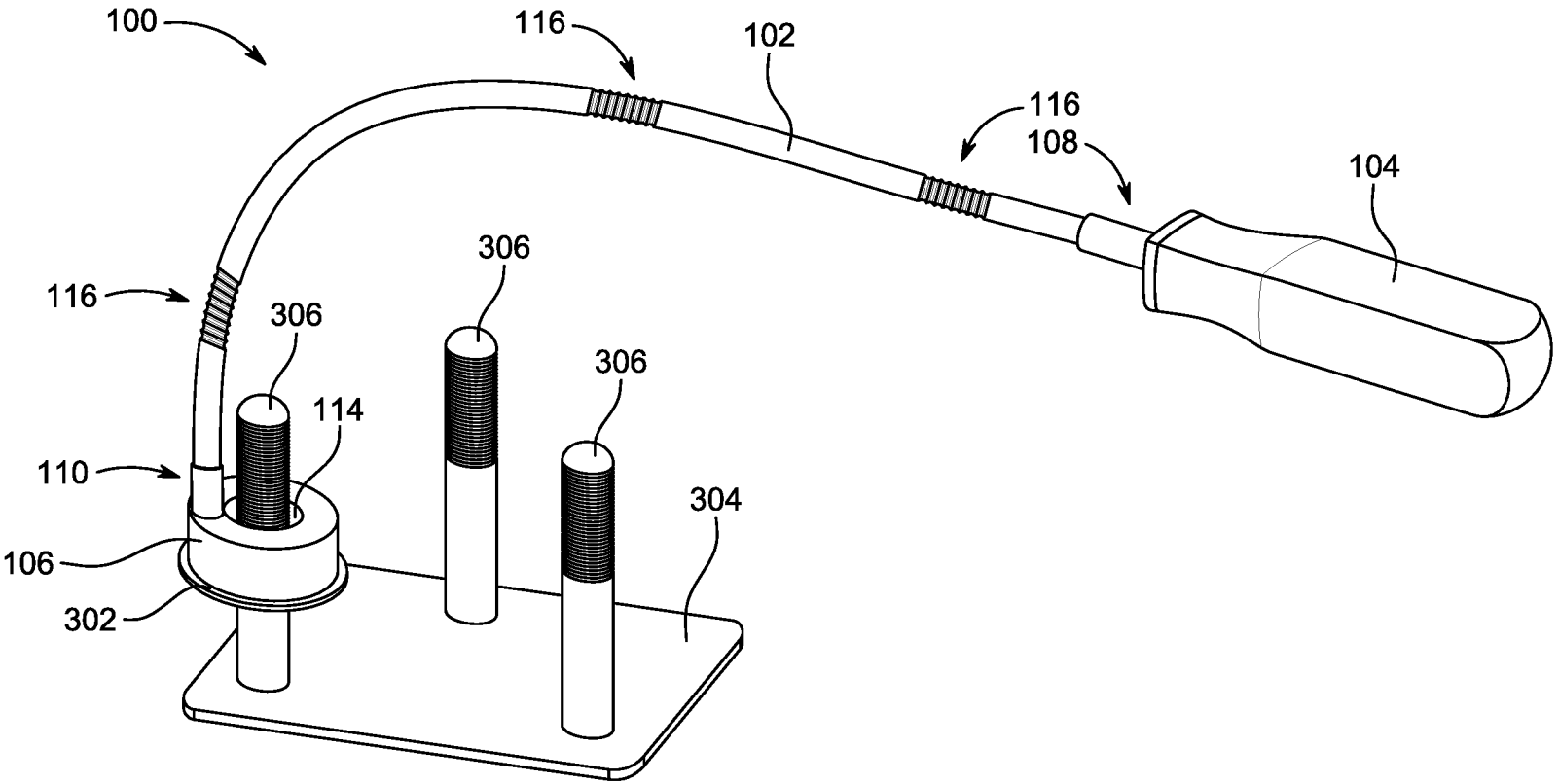
FIG. 3 illustrates a scenario showing the tool retrieving the magnetic objects, according to an embodiment of the present disclosure.

As shown in FIG. 3, the tool 100 may be used to retrieve a magnetic object 302 from a surface 304 of an automobile engine (not shown). In one example, the magnetic object 302 may be a washer. At first, the tool 100 is inserted into the stud 306 of the automobile engine. The magnetic head 106 of the tool 100 is magnetically engaged with the magnetic object 302 such as washer or shim. Further, the flexible rod 102 may then be flexed to a desired configuration to place the handle 104 in a desirable remote location and orientation. The magnetic object 302 may then be fully unscrewed/removed from the surface 304 of the automobile engine. It should be noted that the cavity of the magnetic head 106 may further secure the magnetic object 302 and may be advantageously provided for easy and secure retrieval of the magnetic objects from the inaccessible area like the stud 306 in the automobile engine. Thus, such usage of the tool 100 provides quick retrieval of the magnetic object 302 from the stud 306 placed on the surface 304 of the automobile engine.

In one example embodiment, the tool 100 may be a part of a toolkit, comprised of a plurality of magnetic heads of different sizes, shapes, strengths, etc. and a plurality of flexible rods of variable lengths. Further, the magnetic head 106 may be available in shapes like recessed, concave, or convex. In one example embodiment, the flexible rod 102 may be statically-positionable. In one example embodiment, the length of the flexible rod 102 may be adjusted based on the height of the stud 306 of the automobile engine. In a further example, the length of the flexible rod 102 may be adjusted to reach areas that are closer or farther away from the user of the tool 100, respectively. In one example embodiment, the flexible rod 102 may be extendable/retractable, using a plurality of extendable/retractable sections 116. The plurality of extendable/retractable sections 116 may be provided at various points along the length of the flexible rod 102. It should be noted that the plurality of extendable/retractable sections 116, may be advantageously provided for allowing a user to set different lengths of the flexible rod 102, as per the requirement of the user.

Further, the tool 100 may be advantageously provided with a light member (not shown). The light member may preferably include a light-emitting member which may suitably be any conventional light bulb, preferably of a small wattage to suit the intended purpose. In one case, the light member may be disposed within the handle 104, to aid user visibility of automotive engine sections. The light member may be selected to fit within the tool 100, for contact with a conventional battery so as to provide charge to the light-emitting member and cause the light-emitting member to emit light. The light-emitting member may include a conventional power source such as one or more batteries. It should be noted that the light may at least be a visible light, an ultraviolet light, an infra-red light, etc. without departing from the scope of the disclosure. The light member may aid visibility for use of tool 100 in dark environments. It should be noted that the light member may emit light along the central axis and through an opening of the through-hole 114 of the magnetic head 106, to illuminate the magnetic object 302 or an area around the magnetic object 302. In addition, the light member may be disposed within/on the magnetic head 106, to aid user visibility of autonomous engine sections. Further, the light member, as well as the light bulb and battery contacting portions of the present invention are likewise structures well known to a person of ordinary skill in the art.

In one example embodiment, the tool 100 may be used to install and retrieve the magnetic object 302. Without departing from the scope of or further limiting the present invention, a small, unique, flexible, and universal design of the first embodiment may facilitate the accomplishment of tedious, difficult, awkward, and messy operations a simple and easy job. Further, the tool 100 may provide easy access in locations of limited access, for example, by configuring the tool 100 to a small size, using a strong magnetic head 106, providing more flexibility of the flexible rod 102, and/or configuring the handle 104 to rotate and provide additional gripping means to hold the handle 104.

Figure 4:
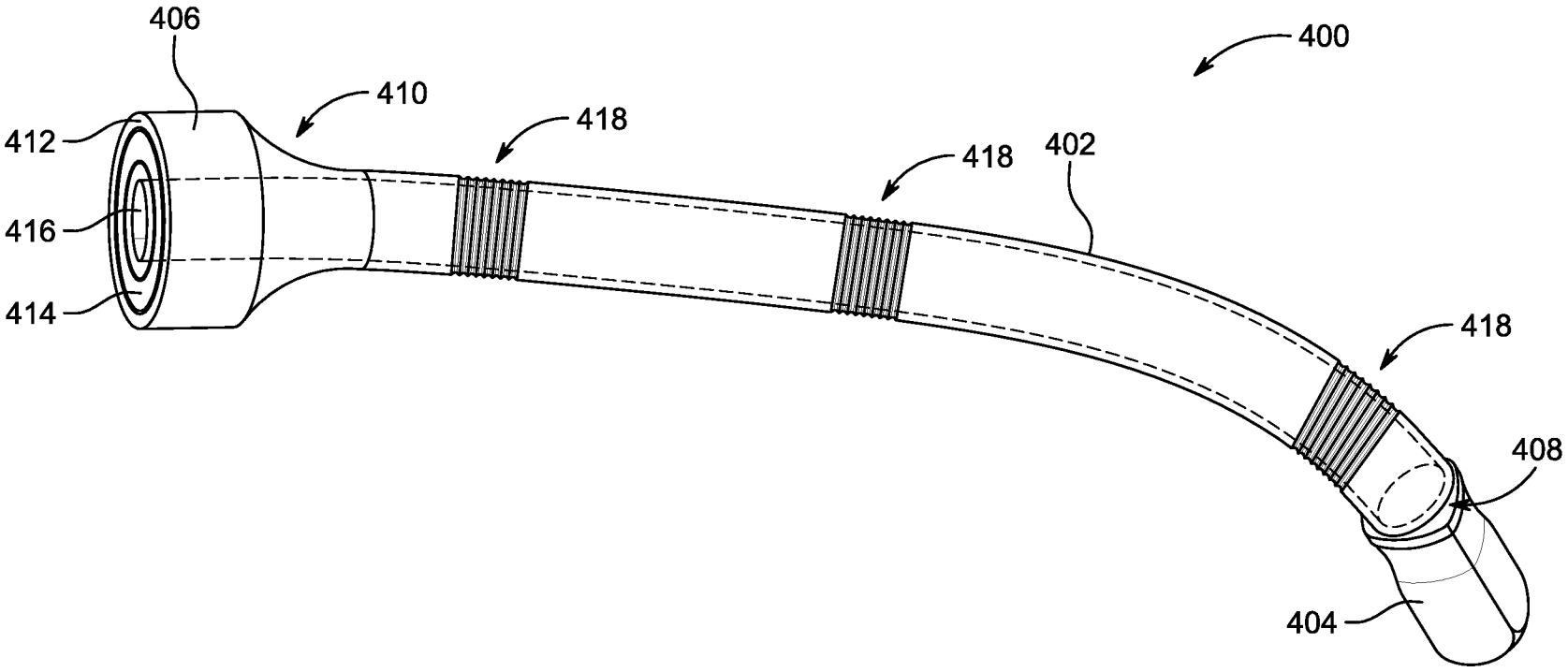
FIG. 4 illustrates a perspective view of another design of a tool for retrieving the magnetic objects, according to a second embodiment of the present disclosure.

FIG. 4 illustrates a perspective view of another design of a tool 400 for retrieving magnetic objects in accordance with an embodiment of the present disclosure. The tool 400 may comprise a flexible rod 402, a handle 404, and a magnetic head 406.

As shown in FIG. 4, the flexible rod 402 may be a semi-rigid in nature and may be fashioned to assume various semi-rigid shapes or configurations—e.g., straight, curved, multi-curved, angular, etc. In an example embodiment, the flexible rod 402 may preferably be manufactured from steel though other materials—e.g., aluminum, elastomeric, etc.—may be used given their semi-rigid flexibility properties. The flexible rod 402 may be used to allow the magnetic head 406 to be oriented in different directions for retrieval of the magnetic objects. Further, the handle 404 may be configured to be detachably coupled to a first end 408 of the flexible rod 402. The handle 404 may preferably be manufactured from a lightweight durable rigid material, such as plastic. Further, the magnetic head 406 may be configured to be detachably coupled to a second end 410 of the flexible rod 402. In one example embodiment, the magnetic head 406 may be coupled to the flexible rod 402 via a screwing mechanism. As shown in FIG. 4, the magnetic head 406 is preferably a cylindrical member defining a pickup surface 412. In one example embodiment, the pickup surface 412 may be a cavity (not shown), for accepting and securing a magnetic object 414.

In one example embodiment, the flexible rod 402 may be extendable/retractable, using a plurality of extendable/retractable sections 418. The plurality of extendable/retractable sections 418 may be provided at various points along the length of the flexible rod 402. It should be noted that the plurality of extendable/retractable sections 418, may be advantageously provided for allowing a user to set different lengths of the flexible rod 402, as per the requirement of the user.

Figure 5:
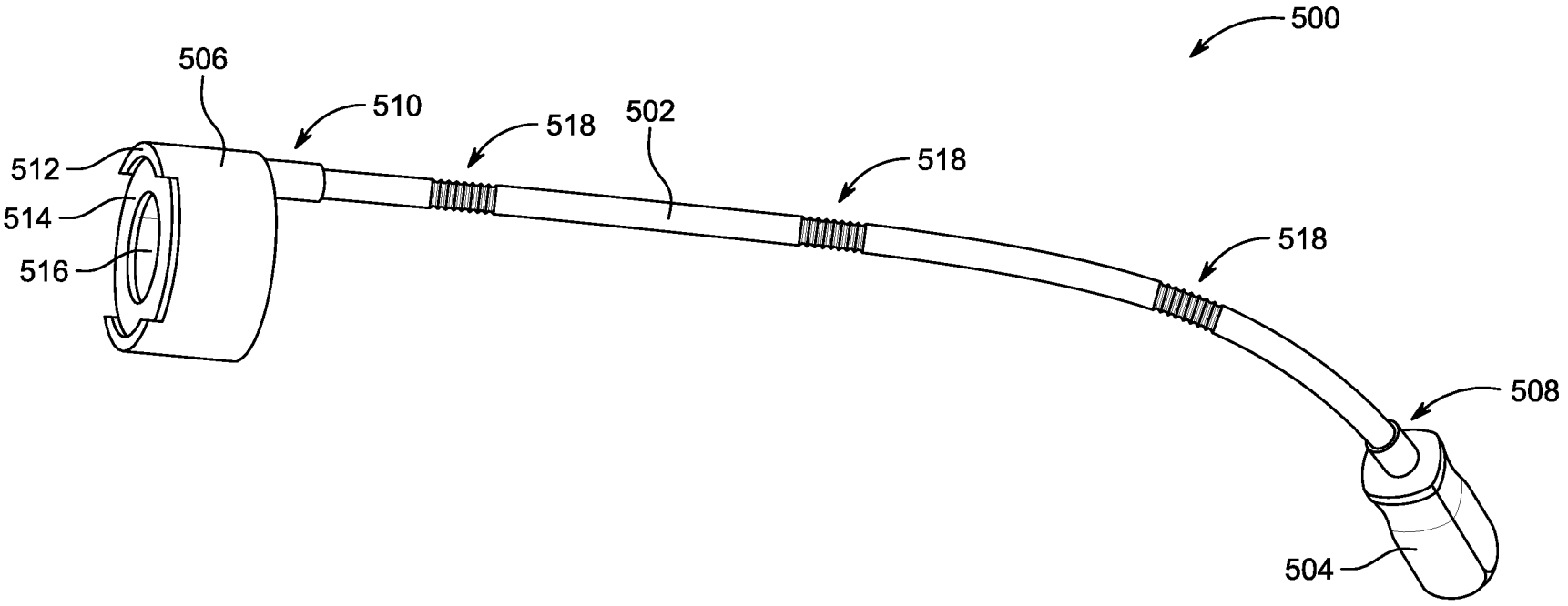
FIG. 5 illustrates a perspective view of another design of a tool for retrieving the magnetic objects, according to a third embodiment of the present disclosure.

As discussed above, the magnetic head 406 may be a permanent magnet or may comprise of a ferromagnetic material, such as steel, configured to be magnetically engaged as the magnetic head 406. It should be noted that the magnetic head 406 may be made of any other magnetic material as well, without departing from the scope of the disclosure. In one example embodiment, as shown in FIG. 4, the tool 400 may be provided with a through-hole 416, extending through the flexible rod 402 till the magnetic head 406. It should be noted that the through-hole 416 may be advantageously provided for the tool 400 to access the magnetic object 414 like fasteners or washers from studs in automobile engines. Further, the through-hole 416 of the magnetic head 406 may be demagnetized, to prevent the tool 400 from adhering or attaching to the studs, pins, and the like FIG. 5 illustrates a perspective view of another design of a tool 500 for retrieving magnetic objects in accordance with an embodiment of the present disclosure. The tool 500 comprises a flexible rod 502, a handle 504, and a magnetic head 506. As shown in FIG. 5, the flexible rod 502 may be a semi-rigid in nature. In an example embodiment, the flexible rod 502 may be preferably manufactured from steel. It should be noted that the flexible rod 502 may be advantageously used in adverse locations where a flexible tool is required to remain fixed in shape. The flexible rod 502 may be used to allow the magnetic head 506 to be oriented in different directions for retrieval of the magnetic objects and be fashioned to assume various semi-rigid shapes or configurations—e.g., straight, curved, multi-curved, angular, etc. Further, the handle 504 may be configured to be detachably coupled to a first end 508 of the flexible rod 502. The handle 504 may preferably be manufactured from a lightweight durable rigid material, such as plastic. Further, the magnetic head 506 may be configured to be detachably coupled to a second end 510 of the flexible rod 502.

In one example embodiment, the flexible rod 502 may be extendable/retractable, using a plurality of extendable/retractable sections 518. The plurality of extendable/retractable sections 518 may be provided at various points along the length of the flexible rod 502. It should be noted that the plurality of extendable/retractable sections 518, may be advantageously provided for allowing a user to set different lengths of the flexible rod 502, as per the requirement of the user.

As shown in FIG. 5, the magnetic head 506 is preferably a cylindrical member defining a pickup surface 512. In one example embodiment, the pickup surface 512 may be a cavity (not shown), for accepting and securing a magnetic object 514, as shown in FIG. 5. The magnetic head 506 may be a permanent magnet or may comprise of a ferromagnetic material, such as steel, configured to be magnetically engaged as the magnetic head 506. It should be noted that the magnetic head 506 may be made of any other magnetic material as well, without departing from the scope of the disclosure. Furthermore, the magnetic head 506 may be configured in accordance with the exemplary embodiments of the magnetic head 106 and the magnetic head 406.

In one example embodiment, the magnetic head 506 may be a recessed magnetic head. It should be noted that the recessed magnetic head is advantageously provided to access to the magnetic object 514 such as washers or shim of design as corresponding to the shape of the recessed magnetic head 506. In one example embodiment, as shown in FIG. 5, the tool 500 may be provided with a through-hole 516, in the magnetic head 506. It should be noted that the through-hole 516 may be advantageously provided for the tool 500 to access the magnetic object 514 like fasteners or washers from areas with complex and/or limited accessibility such as studs in automobile engines.

Thus, the tool 100, 400, or 500 may provide a remote placement, initial installation, and/or retrieval of the magnetic objects such as washers, springs and shims from automobile engines. It will be apparent to one skilled in the art that the above-mentioned components of the tool 100, 400, or 500 have been provided only for illustration purposes. The tool 100, 400, or 500 may include one or more components such as a light handle grip, as well, without departing from the scope of the disclosure.

While there is shown and described herein certain specific structures illustrating various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A tool for retrieving magnetic objects, the tool comprising:

a flexible rod;

a handle coupled to a first end of the flexible rod;

a light member disposed within/on the handle which aids a user visibility in dark environments; and a magnetic head coupled to a second end of the flexible rod, wherein the magnetic head comprises a through-hole for retrieving the magnetic objects.

2. The tool of claim 1, wherein the flexible rod is statically-positionable.

3. The tool of claim 1, wherein the flexible rod is extendable/retractable for allowing a user to set different lengths of the flexible rod.

4. The tool of claim 1, wherein the flexible rod is configurable to allow the magnetic head to be oriented in different directions for retrieval of the magnetic objects.

5. The tool of claim 1, wherein the handle is detachably coupled to the first end of the flexible rod.

6. The tool of claim 1, further comprising a light member disposed within/on the magnetic head, to aid user visibility of autonomous engine sections.

7. The tool of claim 1, wherein the magnetic head is detachably coupled to the second end of the flexible rod.

8. The tool of claim 1, wherein the magnetic head is comprised of a planar surface for retrieving the magnetic objects.

9. The tool of claim 1, wherein the magnetic head is comprised of one or more shapes such as recessed, concave, or convex.

10. The tool of claim 1, wherein the magnetic head is coupled to the flexible rod via a screwing mechanism.

11. The tool of claim 1, wherein the magnetic head is anodized.

12. The tool of claim 1, wherein the tool is a part of a tool-kit comprising a plurality of magnetic heads of different sizes and flexible rods of variable lengths.

13. A tool kit comprising at least one or a plurality of tools for retrieving magnetic objects, the tool kit comprising:

at least one or a plurality of flexible rods;

at least one or a plurality of handles for coupling to a first end of any of said flexible rods;

a light member disposed within/on the at least one or a plurality of handles to aid a user visibility in dark environments; and a magnetic head coupled to a second end of the flexible rod, wherein the magnetic head comprises a through-hole for retrieving the magnetic objects.

14. The tool kit of claim 13, wherein the tool kit further comprises a plurality of handles having different sizes, and is configured to be detachably coupled to the first end of the flexible rod.

15. The tool kit of claim 13, wherein the tool kit further comprises a plurality of magnetic heads having different shapes, and is configured to be detachably coupled to the second end of the flexible rod.

16. The tool kit of claim 13, wherein the flexible rod is statically-positionable.

17. The tool kit of claim 13, wherein the flexible rod is extendable/retractable for allowing a user to set different lengths of the flexible rod.

18. The tool kit of claim 15, wherein the magnetic head is comprised of a planar surface for retrieving the magnetic objects.

* * * * *